US010542609B2

(12) United States Patent
Jiang

(10) Patent No.: US 10,542,609 B2
(45) Date of Patent: Jan. 21, 2020

(54) STAGE LIGHTING FRAMING SYSTEM OF ENDLESS ROTATION WITH WIRELESS POWER TRANSMISSION AND WIRELESS COMMUNICATION

(71) Applicant: Guangzhou Haoyang Electronic Co., Ltd., Guangzhou, Guangdong (CN)

(72) Inventor: Weikai Jiang, Guangzhou, Guangdong (CN)

(73) Assignee: Guangzhou Haoyang Electronic Co., Ltd. (CN)

( * ) Notice: Subject to any disclaimer, the term of this patent is extended or adjusted under 35 U.S.C. 154(b) by 0 days.

(21) Appl. No.: 16/189,685

(22) Filed: Nov. 13, 2018

(65) Prior Publication Data

US 2019/0313515 A1 Oct. 10, 2019

(30) Foreign Application Priority Data

Apr. 4, 2018 (CN) ..... 2018 1 0298216

(51) Int. Cl.
*F21V 21/15* (2006.01)
*H05B 37/02* (2006.01)
*F21W 131/406* (2006.01)

(52) U.S. Cl.
CPC ..... *H05B 37/0272* (2013.01); *F21V 21/15* (2013.01); *H05B 37/029* (2013.01); *F21W 2131/406* (2013.01)

(58) Field of Classification Search
CPC ..... F21V 21/15; F21W 2131/406; H05B 37/0272; H05B 37/029
See application file for complete search history.

(56) References Cited

U.S. PATENT DOCUMENTS 10,018,338 B2 * 7/2018 Jurik ..... F21V 21/15
2004/0027831 A1 * 2/2004 Huang ..... F21S 10/06 362/363

FOREIGN PATENT DOCUMENTS

CN 205717038 U 11/2016

* cited by examiner

*Primary Examiner* — Ali Alavi
(74) *Attorney, Agent, or Firm* — Lerner, David, Littenberg, Krumholz & Mentlik, LLP

(57) ABSTRACT

The present invention discloses a stage lighting framing system of rotation with wireless power transmission and wireless communication, comprising a rotating disc bracket, a fixing bracket fixedly connected with the rotating disc bracket, a wireless power supply device, and a framing and shaping mechanism rotatably connected with the rotating disc bracket, in which an electromagnetic field transmitting device is arranged on the fixing bracket, an electromagnetic field receiving device is arranged on the framing and shaping mechanism which is driven by a first drive device for unrestricted angle rotation. It further includes a wireless signal transmission device, and correspondingly a wireless signal receiving device arranged on the framing and shaping mechanism. The present invention can supply continuous power to a framing and shaping mechanism without a cable to achieve wireless power supply. Therefore, the framing and shaping mechanism will have greater rotational freedom and achieve richer light-beam shaping effects.

19 Claims, 6 Drawing Sheets

STAGE LIGHTING FRAMING SYSTEM OF ENDLESS ROTATION WITH WIRELESS POWER TRANSMISSION AND WIRELESS COMMUNICATION

CROSS REFERENCE TO RELATED APPLICATIONS

The present application claims priority from Chinese Patent Application No. 201810298216.9, filed Apr. 4, 2018, the disclosure of which is hereby incorporated herein by reference.

TECHNICAL FIELD

The invention relates to the field of stage lighting technology, and, in particular, to a stage lighting framing system of endless rotation with wireless power transmission and wireless communication.

BACKGROUND ART

With the continuous development of lighting technology, the requirements of audiences for lighting effects become increasingly higher. In order for audiences to observe more exquisite and more beautiful light effects, a light-beam framing and shaping device is required to be used in a stage lighting luminaire to shape light beam for different light effects. In the stage lighting luminaire, it is often required to continuously rotate the light-beam framing and shaping device to obtain richer lighting effects with more levels. However, a traditional stage lighting luminaire rotates at a limited angle, and will cause wires therein to intertwine each other after rotating for a certain angle, resulting in a failure of the stage lighting luminaire. In order to solve this problem, application CN 201620360678 discloses a light-beam framing and shaping rotation structure and a stage lighting luminaire. The light-beam framing and shaping rotation structure includes an annular shaping and fixing bracket, a bracket cover plate fixed on one side of the annular shaping and fixing bracket, a framing and shaping mechanism rotatably connected to the other side of the annular shaping and fixing bracket, and a conductive slip ring set in the middle of the annular shaping and fixing bracket, in which one side of the conductive slip ring is fixed to the bracket cover plate and the other side thereof is connected to the framing and shaping mechanism. The invention achieves a sliding electrical connection by a first conductive plate and a second conductive plate in the conductive slip ring. However, the first conductive plate and the second conductive plate are in contact with each other in operation, causing that the first conductive plate and the second conductive plate may rub together and generate a large amount of heat during the high-speed rotation. Therefore, it is prone to cause abrasion of the first conductive plate and the second conductive plate, resulting in poor contact between the first conductive plate and the second conductive plate and short service life. In addition, a large amount of energy is converted into heat energy during use, as a result, the energy consumption is increased and the speed of rotation is limited in order to avoid accident caused by excessive heat generated by an excessive rotation speed. Further, the first conductive plate and the second conductive plate must be in contact, so that two ends of the conductive slip ring cannot be too far apart, otherwise the cost and implementation difficulty will be greatly increased.

SUMMARY OF THE INVENTION

An object of the present invention is to provide a stage lighting framing system of endless rotation which can achieve contactless wireless power transmission and wireless communication.

In order to achieve the object, the present invention provides the technical solutions as follows.

According to the present invention, a stage lighting framing system of endless rotation with wireless power transmission and wireless communication is provided, including a rotating disc bracket, a fixing bracket fixedly connected with the rotating disc bracket, a wireless power supply device and a framing and shaping mechanism rotatably connected with the rotating disc bracket, in which the framing and shaping mechanism driven by a first drive device for rotation at infinite angle is configured to intercept and frame a light beam so as to obtain different lighting effects, and is provided with a second drive device for driving a framing and shaping piece thereon to function; in which the wireless power supply device includes an electromagnetic field transmitting device arranged on the fixing bracket and an electromagnetic field receiving device arranged on the framing and shaping mechanism for transmitting power to the second drive device. The stage lighting framing system of endless rotation further includes a wireless signal transmission device, and a wireless signal receiving device corresponding to the wireless signal transmission device, which is arranged on the framing and shaping mechanism.

The present invention can supply continuous power to a framing and shaping mechanism by an electromagnetic field transmitting device and an electromagnetic field receiving device without any cable or contact between a framing and shaping mechanism and a fixing bracket, thus achieving wireless power supply for the framing and shaping mechanism. Therefore, the present invention can offer additional benefits as follows to the existing prior art. Firstly, it can avoid the abrasion of the framing and shaping mechanism and the fixing bracket, which is caused by mutual rotation and friction, so that the service life of the entire system may be improved. Secondly, since the friction heat caused by mutual rotation of the framing and shaping mechanism and the fixing bracket is avoided, the energy utilization efficiency of the entire system is greatly improved while the constraint of the rotation speed of the framing and shaping mechanism is solved, so that richer lighting effects can be displayed with higher speed. Thirdly, the distance limitation between the framing and shaping mechanism and the fixing bracket is removed, which is convenient to design the system according to the needs, such as setting multiple framing and shaping mechanisms to display different light effects. Furthermore, in order to adjust charging effects in time by sending charging information to the electromagnetic field receiving device and the electromagnetic field transmitting device, and allow people to connect a peripheral control panel (i.e., a control panel of a stage lighting luminaire) with the wireless signal transmission device via cable signals and to adjust the rotation speed of the framing and shaping mechanism and the light beam framing manner via the peripheral control panel, so as to display different lighting effects, the present invention is further provided with a wireless signal transmission device and a wireless signal receiving device. Compared with the manner of transmitting a signal by a total wireless signal transmission device of a total control terminal, a transmission device such as a Bluetooth or infrared rays, which has a short transmission distance but relatively low cost, can be used as the wireless signal transmission device and the wireless signal receiving device, which can reduce the cost. Moreover, it can also avoid signal confusion, caused by the total wireless signal transmission device simultaneously transmitting signals to several wireless signal receiving devices.

Preferably, the framing and shaping mechanism is provided with a motor control device which is in signal connection with the second drive device and the wireless signal receiving device, and is electrically connected with the electromagnetic field receiving device. The motor control device can be a microcontroller, a motor drive circuit, or the like.

The motor control device is set to better control the output power of the electromagnetic field receiving device, so as to comply with operations of the drive device and the framing and shaping mechanism, and to create beautiful light and shadow effects by cooperating with a light source.

More preferably, the stage lighting framing system of endless rotation is provided with several wireless signal transmission devices which are preferably set on the fixing bracket, and several wireless signal receiving devices corresponding to the wireless signal transmission devices are arranged on the framing and shaping mechanism.

A strong magnetic field is generated when signals are transmitted by wireless power, which is prone to affect information propagation of the wireless signal transmission device, so the present invention adopts two independent wireless communication units to improve the reliability of the wireless communication, in which a first communication unit works as a main communication unit, and a second communication unit works as a backup communication unit, the main communication unit will switch to the second communication unit when failing or producing excessive noises, so that such redundant design on the hardware improves the reliability of wireless communication.

Preferably, the wireless signal transmission device and the wireless signal receiving device are provided with a micro controller unit (MCU).

By using the micro controller unit (MCU) to adjust their transmission frequency, the wireless signal transmission device can individually match the wireless signal receiving device. Alternatively, the wireless signal transmission device can only individually match, by means of setting a specific identification ID via the micro controller unit (MCU), the wireless signal receiving device without affecting other devices.

Preferably, the electromagnetic field receiving device and the electromagnetic field transmitting device perform wireless power transmission by means of magnetic resonance or electromagnetic induction.

Since the wireless power transmission manner of the electromagnetic induction is simple, the requirements for a wireless charging device are reduced, required equipment is simple, and short the distance between the electromagnetic field receiving device and the electromagnetic field transmitting device completely complies with the wireless power transmission manner of the electromagnetic induction. The maximum difference between the magnetic resonance manner and the electromagnetic induction manner is whether an oscillator is set, through which a resonance effect will be generated between the electromagnetic field receiving device and the electromagnetic field transmitting device, causing higher transmission efficiency and larger transmission power Preferably, the wireless signal transmission device and the wireless signal receiving device transmit information via a high-frequency signal.

Preferably, the framing and shaping mechanism includes a framing and shaping bracket rotatably connected with the rotating disc bracket, and a framing and shaping body set on the framing and shaping bracket.

Preferably, the electromagnetic field transmitting device includes an electromagnetic field transmitting coil, a first mounting assembly for mounting the electromagnetic field transmitting coil, and an electromagnetic field transmission and wireless control circuit board for controlling transmission power of the electromagnetic field transmitting coil. The electromagnetic field receiving device includes an electromagnetic field receiving coil, a second mounting assembly for mounting the electromagnetic field receiving coil, and an electromagnetic field receiving and wireless control circuit board for converting an alternating current output from the electromagnetic field receiving coil into a direct current.

More preferably, the electromagnetic field transmission and wireless control circuit board includes an oscillator for converting a direct current into an alternating current, and the electromagnetic field transmitting device further includes a power control circuit and a filter. After entering the electromagnetic field transmitting device, an external current pass through the oscillator, the power control circuit, the filter, and the electromagnetic field transmitting coil in sequence, so that the electromagnetic field transmitting coil generates a strong varying magnetic field, and the electromagnetic field receiving coil converts the strong electromagnetic field into an alternating current by electromagnetic induction.

In order to reduce noise interference and improve dynamic response of the power transmission, the present invention, by setting a power control circuit, collects the instantaneous output current and voltage conditions of the electromagnetic field transmitting coil and then adjusts a duty ratio of an output pulse to satisfy dynamic changes of a load, and sets a filter to remove noise from the circuit.

Preferably, the fixing bracket is provided with a fixing member, on which the first mounting assembly in annular shape is fixed, and the electromagnetic field transmitting coil is nested inside the first mounting assembly.

Preferably, the electromagnetic field receiving coil is nested inside the second mounting assembly which can also be in annular shape and fixed to the framing and shaping mechanism.

More preferably, the wireless signal transmission device includes a wireless controller and a transmitting antenna. Both of the transmitting antenna and the wireless controller can be arranged on the electromagnetic field transmission and wireless control circuit board. Alternatively, the transmitting antenna is arranged on the first mounting assembly, and the wireless controller is arranged on the electromagnetic field transmission and wireless control circuit board.

More preferably, the wireless signal receiving device includes a wireless controller and a receiving antenna. Both of the receiving antenna and the wireless controller can be arranged on the electromagnetic field receiving and wireless control circuit board. Alternatively, the receiving antenna is arranged on the second mounting assembly, and the wireless controller is arranged on the electromagnetic field receiving and wireless control circuit board.

When the transmitting antenna and the receiving antenna are arranged on the first mounting assembly of the electromagnetic field transmitting coil and on the second mounting assembly of the electromagnetic field receiving coil respectively, the transmitting antenna and the receiving antenna are in annular shape, the central axes of the annular antennas are coincident and remain coincident during the rotation at unrestricted angle.

A preferred mounting method is that the first mounting assembly is provided with a first annular extending sidewall on which the transmitting antenna is arranged, the second mounting assembly is provided with a second annular extending sidewall on which the receiving antenna is arranged, and the two antennas are opposingly set when the first mounting assembly and the second mounting assembly are mounted cooperatively. In the related prior art, two antennas are respectively set on two point positions of the rotating disc bracket and the framing and shaping bracket. In such configuration, when the rotating disc bracket rotates relative to the framing and shaping bracket, the two antennas sometimes appear at relatively distant positions, resulting in signal instability. In addition, for stage lighting luminaires set side by side, the distance between antennas on adjacent stage lighting luminaires is shorter than that between antennas on the same stage lighting luminaire, resulting in a phenomenon of signal crosstalk. The transmitting antenna and the receiving antenna are circularly opposingly set in the present invention, so that the signal will be more stable, misoperation due to crosstalk of the antenna signal will be avoided, and unblocked signals will be maintained.

In order to further reduce the impact of the electromagnetic field coil on other electrical components in the stage lighting luminaire, especially on a motor of the framing and shaping bracket, a first nested internal cavity of the first mounting assembly for mounting the electromagnetic field transmitting coil is partially overlapped with a second nested internal cavity of the second mounting assembly for mounting the electromagnetic field receiving coil, so that the electromagnetic field transmitting coil is sufficiently close to the electromagnetic field receiving coil. Such configuration can ensure more sufficient power transfer of the coil and avoid outward radiation of the magnetic energy.

In order to further reduce the electromagnetic field on other equipment, the first nested internal cavity is provided with a magnet around the electromagnetic field transmitting coil, and the second nested internal cavity is provided with a magnet around the electromagnetic field receiving coil, which will greatly enhance the efficiency of power transfer.

Preferably, the first drive device includes a drive motor set on the fixing bracket or the rotating disc bracket, a driving wheel connected with the drive motor, and a driven wheel which is connected with the driving wheel and is provided on the framing and shaping mechanism, the drive motor can drive the driving wheel and the driven wheel to rotate at infinite angle.

Alternatively, the first drive device includes a drive motor set on framing and shaping mechanism, a driving wheel connected with the drive motor, and a driven wheel which is connected with the driving wheel and is provided on the rotating disc bracket, the drive motor can drive the driving wheel and the driven wheel to rotate at infinite angle.

The driving wheel and the driven wheel are 360° rotating gears, which can achieve rotate at infinite angle.

The present invention further relates to a stage lighting luminaire including a light source, and an above-mentioned stage lighting framing system of endless rotation with wireless power transmission and wireless communication, which corresponds to the light source. When a light beam emitted by the light source passes through a hollow hole of the framing and shaping mechanism, the framing and shaping mechanism can shape the light beam while rotating, and the rotation angle is not limited, so that a wider variety of lighting shapes and better lighting effects can be achieved. Preferably, the stage lighting luminaire further includes a control panel for controlling the light source and the stage lighting framing system of endless rotation.

Compared with the related arts, the present invention offers following benefits.

1. The present invention can prevent the framing and shaping mechanism from driving a cable at the time of rotating, by setting an electromagnetic field transmitting device and an electromagnetic field receiving device, so that the framing and shaping mechanism can have greater rotational freedom, and achieve richer light-beam shaping effects.

2. A wireless signal transmission device and a wireless signal receiving device are configured so that factors such as a speed and power of the framing and shaping mechanism can be obtained and the power transmission effects can be adjusted in time by signal transmission; and people are allowed to adjust the rotation speed and light-beam shaping mode of the framing and shaping mechanism by a peripheral display control panel (i.e., the control panel of the stage lighting luminaire) to display different lighting effects.

Reference signs are as follows: 1: fixing bracket; 11: fixing member; 12: first drive device; 2: first mounting assembly; 21: first annular extending sidewall; 22: magnet; 3: electromagnetic field transmitting coil; 4: electromagnetic field transmission and wireless control circuit board; 5: electromagnetic field receiving and wireless control circuit board; 6: electromagnetic field receiving coil; 7: motor control device; 8: second mounting assembly; 81: second annular extending sidewall; 9: framing and shaping mechanism; 91: second drive device; 92: rotating gear; 10: rotating disc bracket.

DESCRIPTION OF EMBODIMENTS

The present invention will be further illustrated below in conjunction with specific embodiments. It should be understood that these embodiments are only used to illustrate the present invention and are not intended to limit the scope of the present invention. Further, it should be understood that various modifications and changes may be made to the present invention, and these equivalents also fall within the scope defined by the claims appended hereto.

Figure 1:
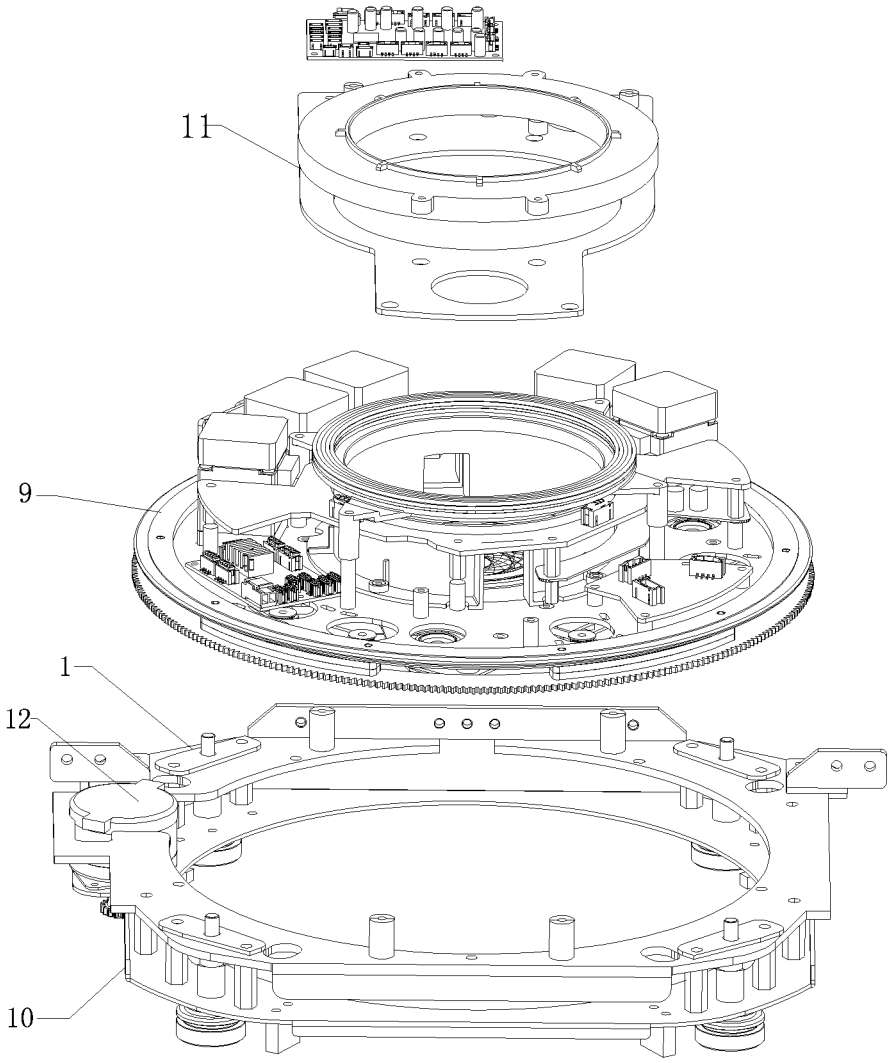
FIG. 1 is an exploded view of the present invention.
Figure 9:
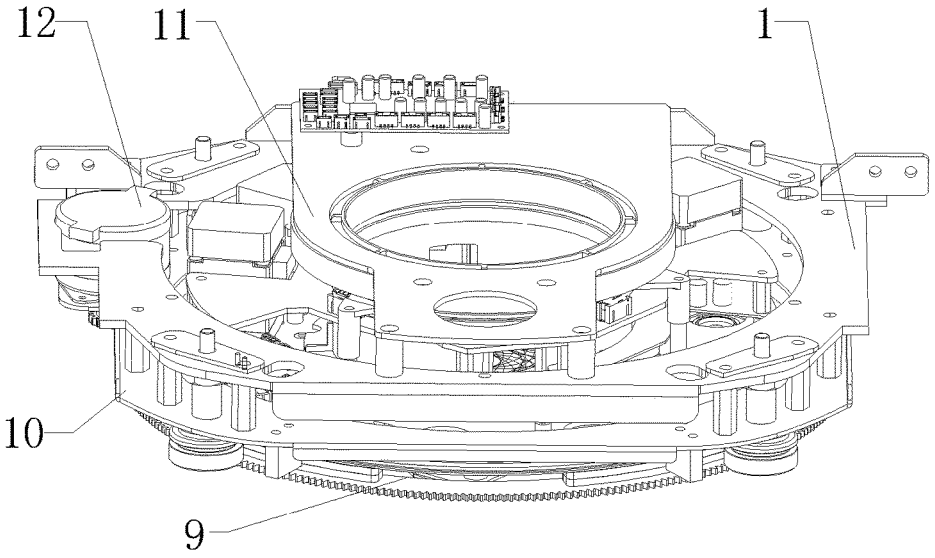
FIG. 9 is a schematic view of the present invention at combination state.

As shown in FIG. 1, a stage lighting framing system of endless rotation with wireless power transmission and wireless communication according to the present invention includes a rotating disc bracket 10, a fixing bracket 1 fixedly connected with the rotating disc bracket 10, a wireless power supply device, and a framing and shaping mechanism 9 rotatably connected with the rotating disc bracket 10, in which the framing and shaping mechanism 9 driven by a first drive device 12 for rotation at infinite angle is configured to intercept and shape a light beam so as to obtain different lighting effects, and is provided with a second drive device 91 for driving a framing and shaping piece thereon to function, in which the wireless power supply device includes an electromagnetic field transmitting device and an electromagnetic field receiving device for transmitting power to the second drive device 91. The stage lighting framing system of endless rotation further includes a wireless signal transmission device, and a wireless signal receiving device corresponding to the wireless signal transmission device, which is arranged on the framing and shaping mechanism 9. When the framing and shaping mechanism 9 rotates, the rotating disc bracket 10 and the fixing bracket 1 are stationary, but the electromagnetic field receiving device and the electromagnetic field transmitting device still perform power transmission. The combined structure of the present invention is shown in FIG. 9.

Figure 2:
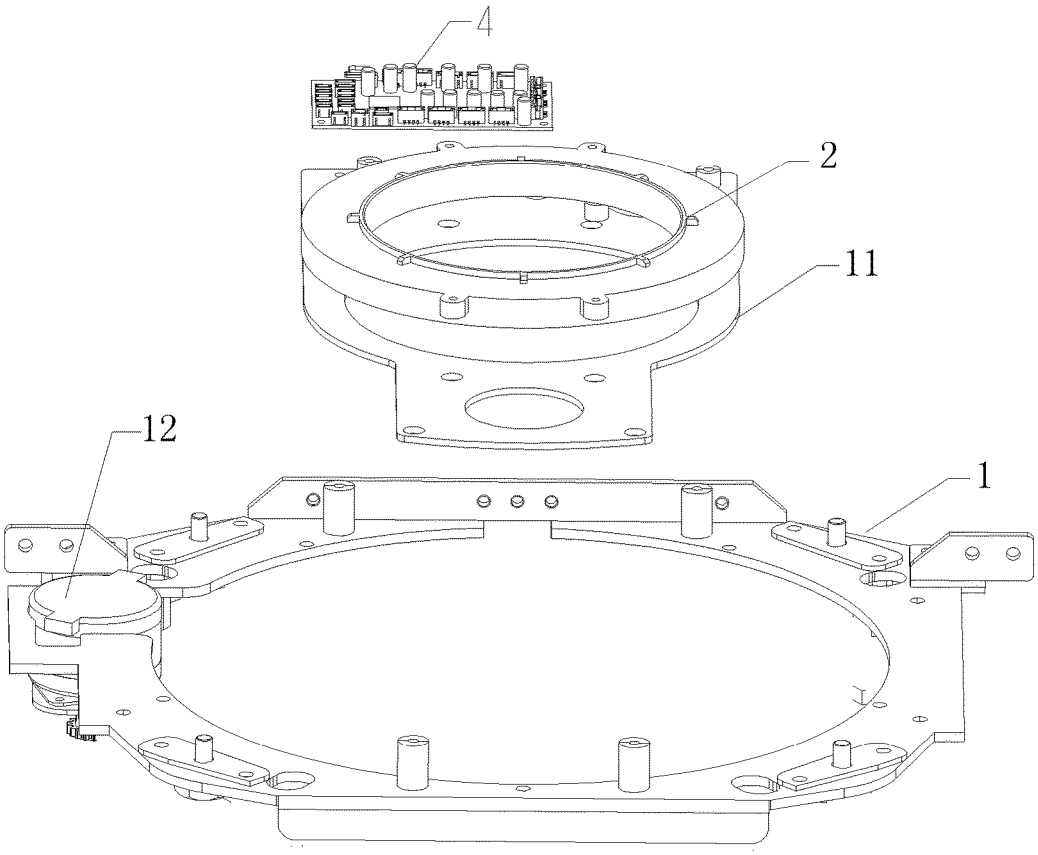
FIG. 2 is a schematic structural view of a fixing bracket.
Figure 5:
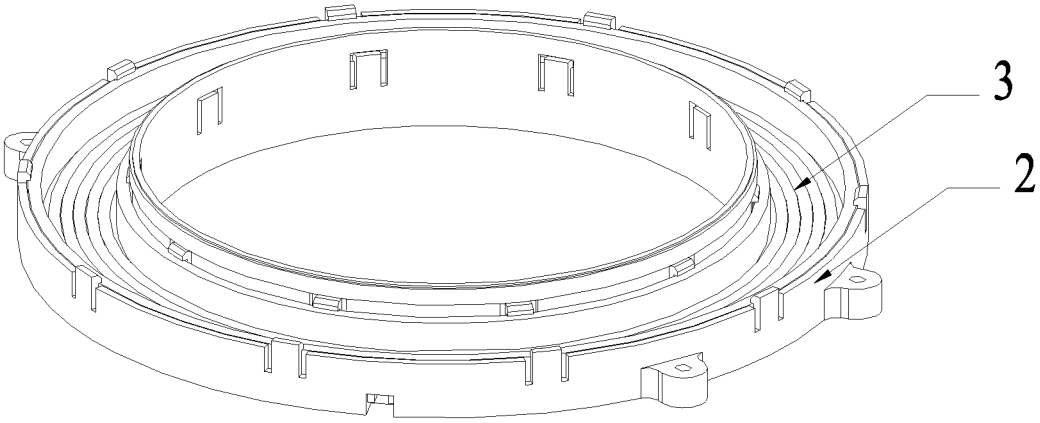
FIG. 5 is a schematic structural view of an electromagnetic field transmitting device.
Figure 6:
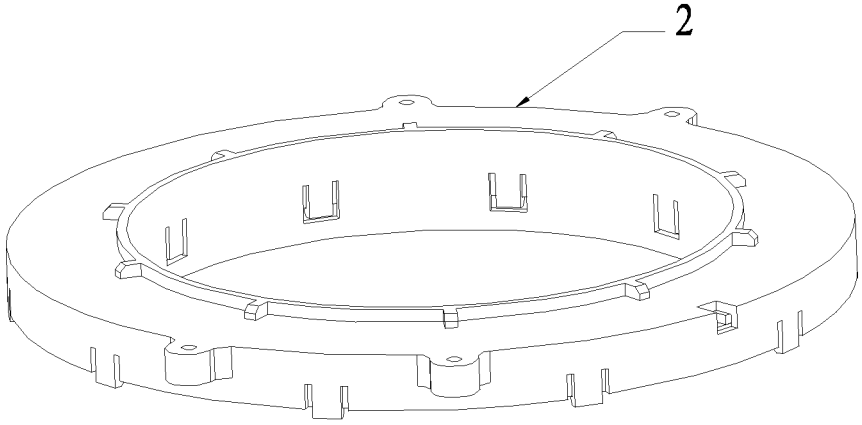
FIG. 6 is a schematic structural view of a first mounting assembly.

As shown in FIG. 2, the fixing bracket includes a fixing member 11, and the electromagnetic field transmitting device set on the fixing bracket includes an electromagnetic field transmitting coil 3, a first mounting assembly 2 for mounting the electromagnetic field transmitting coil, and an electromagnetic field transmission and wireless control circuit board 4 for controlling the transmitting power of the electromagnetic field transmitting coil. As can be seen in conjunction with FIG. 5, the electromagnetic field transmitting coil 3 is nested inside the first mounting assembly 2 which is fixed to the fixing member. The specific structure of the first mounting assembly 2 is shown in FIG. 6.

Figure 3:
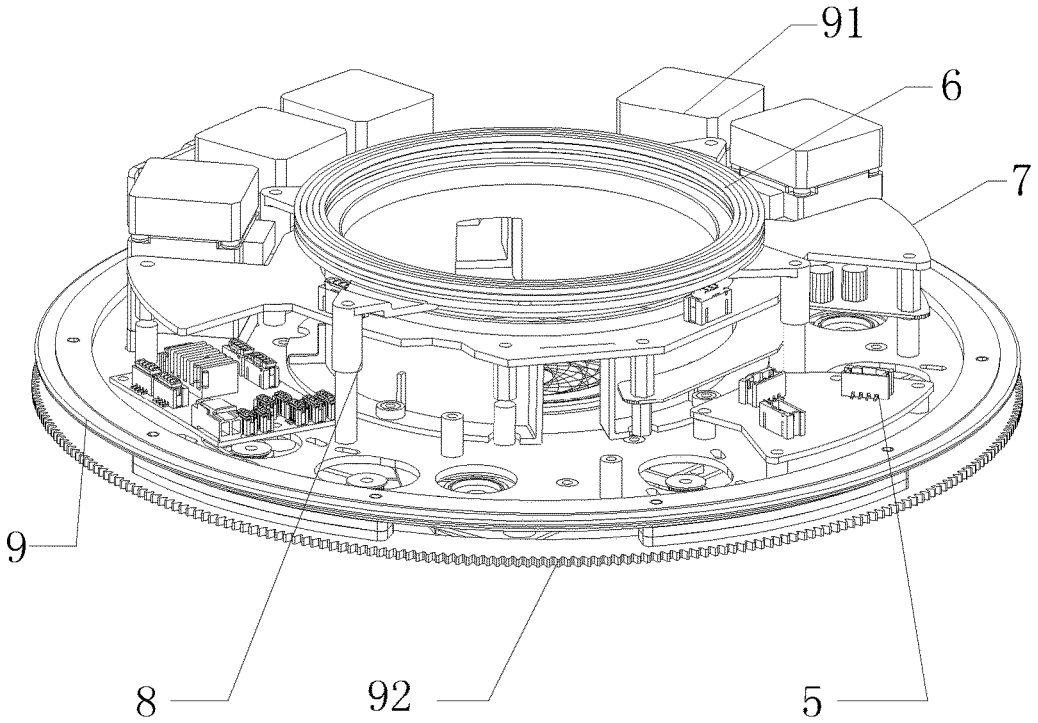
FIG. 3 is a schematic structural view of a framing and shaping mechanism.
Figure 7:
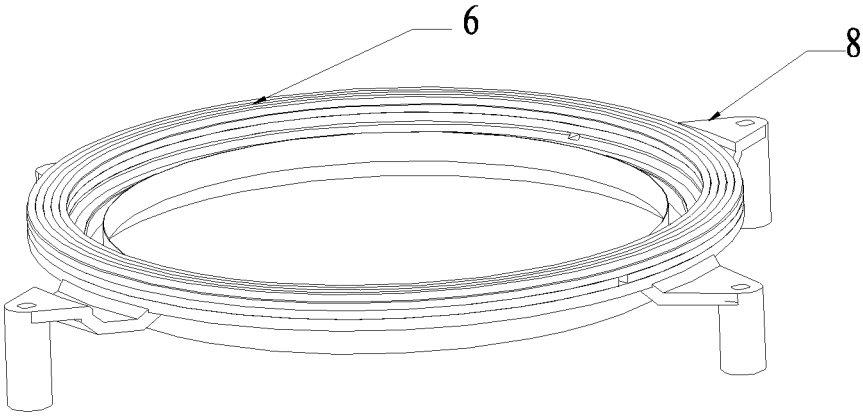
FIG. 7 is a schematic structural view of an electromagnetic field receiving device.

As can be seen from FIG. 3, the electromagnetic field receiving device is arranged on the framing and shaping mechanism 9 for transmitting power to the second drive device 91. The electromagnetic field receiving device includes an electromagnetic field receiving coil 6, a second mounting assembly 8 for mounting the electromagnetic field receiving coil, and an electromagnetic field receiving and wireless control circuit board 5 for converting an alternating current output from electromagnetic field receiving coil into a direct current. As can be seen in connection with FIG. 7, the electromagnetic field receiving coil 6 is nested inside the second mounting assembly 8 which is fixed on the framing and shaping mechanism 9. Both the first mounting assembly 2 and the second mounting assembly 8 may be in annular shape.

The framing and shaping mechanism 9 further includes a framing and shaping bracket rotatably connected with the rotating disc bracket 10, and a framing and shaping body set on the framing and shaping bracket.

The first drive device 12 includes a drive motor set on the framing and shaping mechanism 9, and a driving wheel connected with the drive motor. In the present embodiment, the driving wheel is a rotating gear 92. The rotating disc bracket 10 is provided with a driven wheel and a slide bearing which are connected with the driving wheel. The drive motor drives the driving wheel to rotate at infinite angle, and the driving wheel drives the driven wheel to rotate so as to drive the framing and shaping bracket and the framing and shaping body on the bracket to rotate at infinite angle.

As an alternative, the drive device 91 may also include a drive motor set on the fixing bracket 1 or the rotating disc bracket 10, and a driving wheel connected with the drive motor. The framing and shaping mechanism 9 is provided with a driven wheel connected with the driving wheel. The second drive motor drives the driving wheel to rotate at infinite angle, and the driving wheel drives the driven wheel to rotate so as to drive the framing and shaping bracket and the framing and shaping body on the bracket to rotate at infinite angle.

All the driving wheels and driven wheels are 360° rotating gears so as to achieve rotation at infinite angle.

Figure 4:
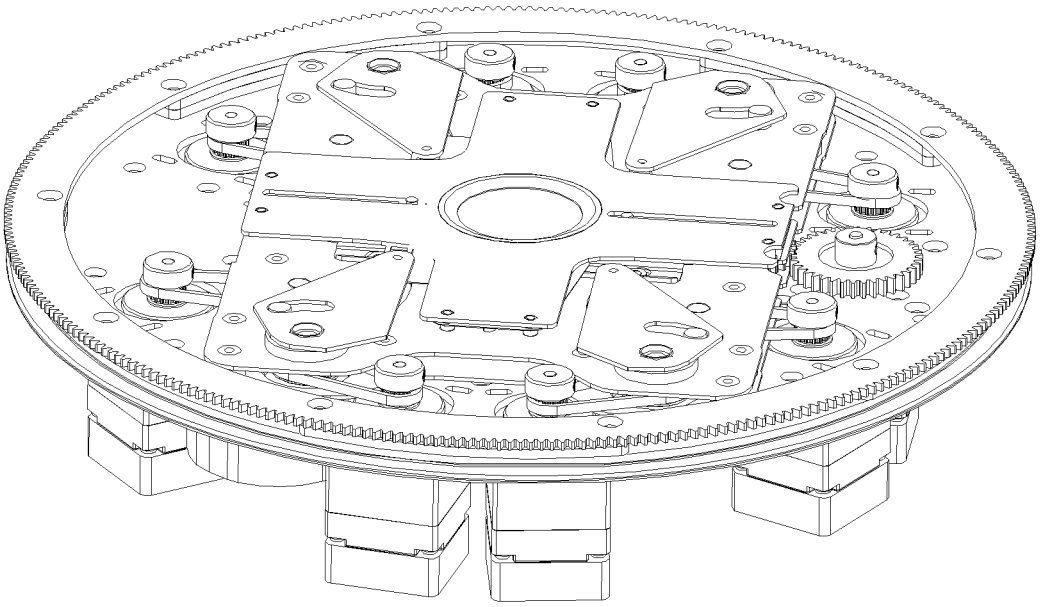
FIG. 4 is a schematic structural view of a rotating disc bracket.

As shown in FIG. 4, the framing and shaping body includes a light framing piece, and a gear set for driving the light framing piece (the light framing piece and the gear set are not marked, but they can be clearly seen from FIG. 4). The motive power of the gear set may be from the drive motor of the framing and shaping body or the drive motor on the framing and shaping bracket. The motor drives the gear to rotate, so that the light framing piece achieves rotation to frame the light beams.

Preferably, as shown in FIG. 3, the framing and shaping mechanism 9 is provided with a motor control device 7 which is in signal connection with the second drive device 91 and the wireless signal receiving device respectively, and is electrically connected with the electromagnetic field receiving device. The motor control device 7 is preferably a microcontroller.

Preferably, the number of wireless signal transmission devices and wireless signal receiving devices may be more than one. The wireless signal transmission device is preferably set on the fixing bracket, and can be adjusted according to actual needs. The wireless signal transmission device and the wireless signal receiving device may be wireless communication equipment such as Bluetooth, a wireless router, and an antenna.

Two-way communication can be achieved between the wireless signal transmission device and the wireless signal receiving device, and the motor control device 7 can send power supply information via the wireless signal transmission device and the wireless signal receiving device. Therefore, the motor control device 7 can adjust the power based on actual conditions or external control to avoid excessive or too small power supply.

Preferably, the wireless signal transmission device and the wireless signal receiving device are provided with a micro controller unit (MCU).

The wireless signal transmission device can only individually match the wireless signal receiving device, without affecting the framing and shaping mechanism 9 in the other lighting devices, by means of setting a specific transmission frequency or transmission key by the micro controller unit (MCU).

Preferably, the electromagnetic field receiving device and the electromagnetic field transmitting device perform wireless power transmission by means of magnetic resonance or electromagnetic induction.

The electromagnetic field transmitting device further includes a power control circuit and a filter. After entering the electromagnetic field transmitting device, an external current passes through an oscillator, the power control circuit, the filter, and the electromagnetic field transmitting coil 3 in sequence, so that the electromagnetic field transmitting coil 3 generates a strong varying magnetic field, and the electromagnetic field receiving coil 6 generates an alternating current by electromagnetic induction. The oscillator, the power control circuit and the filter are integrated in the electromagnetic field transmission and wireless control circuit board 4. The electromagnetic field receiving device includes an electromagnetic field receiving and wireless control circuit board 5 for converting a strong electromagnetic field, received from the electromagnetic field receiving coil 6, into a direct current and an electromagnetic field receiving coil 6. The electromagnetic field receiving and wireless control circuit board 5 is further provided with a rectifier.

Preferably, the wireless signal transmission device includes a wireless controller and a transmitting antenna A. Both of the transmitting antenna A and the wireless controller can be arranged on the electromagnetic field transmission and wireless control circuit board 4. Alternatively, the transmitting antenna A is arranged on the first mounting assembly 2, and the wireless controller is arranged on the electromagnetic field transmission and wireless control circuit board 4.

Preferably, the wireless signal receiving device includes a wireless controller and a receiving antenna B. Both of the receiving antenna B and the wireless controller can be arranged on the electromagnetic field receiving and wireless control circuit board 5.

Alternatively, the receiving antenna Bis arranged on the second mounting assembly 8, and the wireless controller is arranged on the electromagnetic field receiving and wireless control circuit board 5.

Figure 8A:
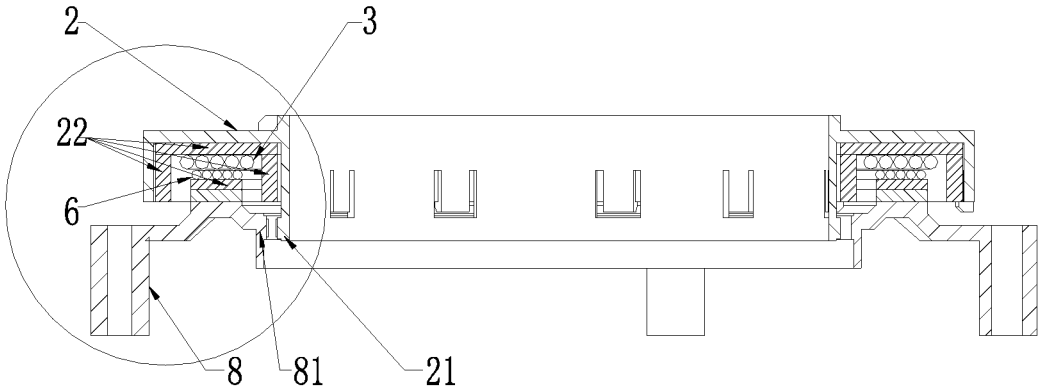
FIG. 8*a* is a partial cross-sectional view of the first mounting assembly and the second mounting assembly when they are mounted cooperatively.
Figure 8B:
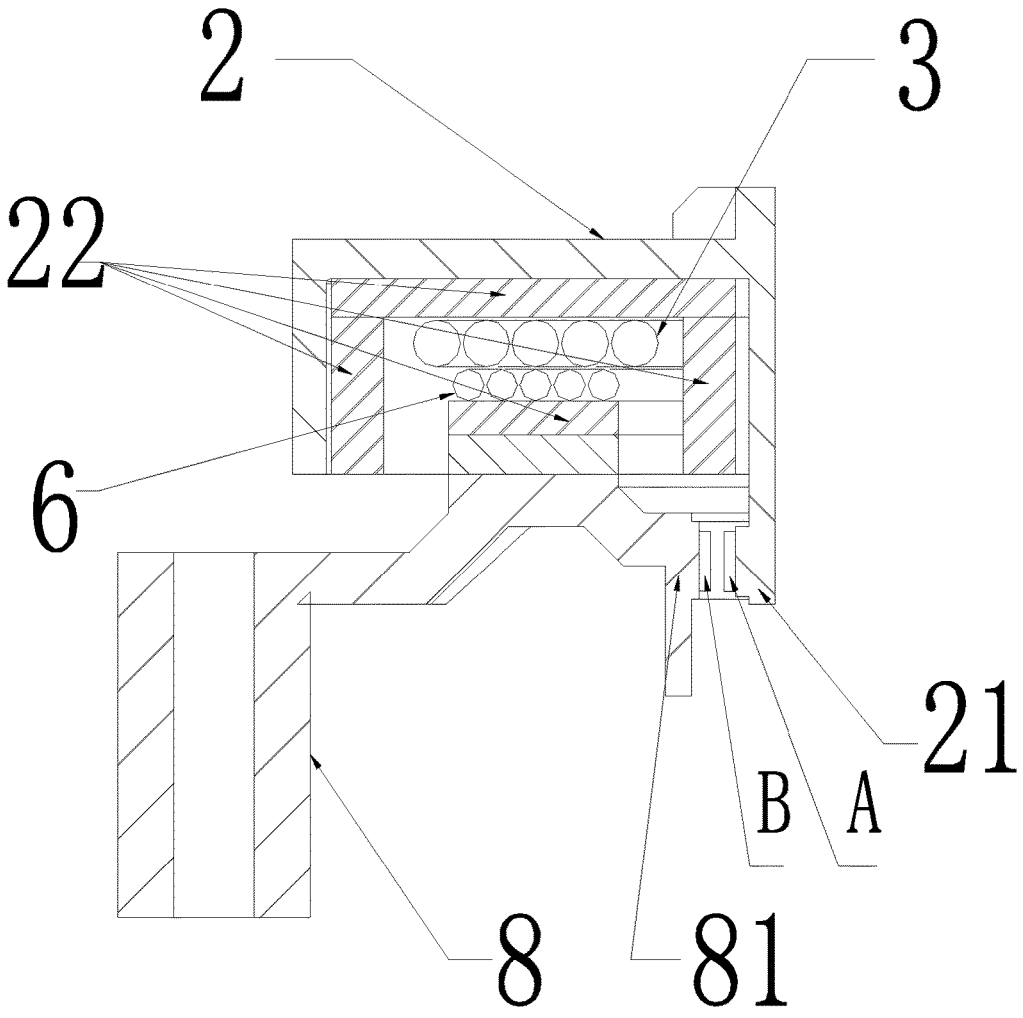
FIG. 8*b* is a partial enlarged view of FIG. 8*a*.

As shown in FIG. 8*a* and FIG. 8*b*, when the transmitting antenna A and the receiving antenna B are provided on the first mounting assembly 2 of the electromagnetic field transmitting coil and on the second mounting assembly 8 of the electromagnetic field receiving coil respectively, the transmitting antenna A and the receiving antenna Bare in annular shape, their central axes are coincident, and the central axes of the annular antennas will remain coincident during the rotation at infinite angle.

In order to effectively prevent signal crosstalk, the first mounting assembly 2 is provided with a first annular extending sidewall 21 on which the transmitting antenna A is arranged, the second mounting assembly 8 is provided with a second annular extending sidewall 81 on which the receiving antenna B is arranged, and the two antennas are oppositely set when the first mounting assembly 2 and the second mounting assembly 8 are mounted cooperatively.

Furthermore, a first nested internal cavity of the first mounting assembly 2 for mounting the electromagnetic field transmitting coil 3 is partially overlapped with a second nested internal cavity of the second mounting assembly 8 for mounting the electromagnetic field receiving coil 6, so that the electromagnetic field transmitting coil 3 is sufficiently close to the electromagnetic field receiving coil 6.

In order to further reduce the interference of electromagnetic field on other equipment, the first nested internal cavity is provided with a magnet 22 around the electromagnetic field transmitting coil 3, and the second nested internal cavity is provided with a magnet 22 around the electromagnetic field receiving coil 6.

The present invention further relates to a stage lighting luminaire including a light source, and an above-mentioned stage lighting framing system of endless rotation with wireless power transmission and wireless communication, which corresponds to the light source. When a light beam emitted by the light source passes through a hollow hole of the framing and shaping mechanism 9, the framing and shaping mechanism 9 can shape the light beam while rotating, and the rotation angle is not limited, so that a wider variety of lighting shapes and better lighting effects can be achieved.

Preferably, the stage lighting luminaire further includes a control panel for controlling the light source and the stage lighting framing system of endless rotation.

Obviously, the above embodiments of the present invention are merely examples for clear illustration, and are not intended to limit the implementations of the present invention. For those of ordinary skill in the art, modifications or changes can be made on the basis of the above description. There is no need and no way to exhaust all implementations. Any modification, equivalent substitution, improvement, or the like within the spirit and principle of the present invention will fall within the scope of the claims of the present invention

The invention claimed is:

1. A stage lighting framing system of endless rotation with wireless power transmission and wireless communication, comprising:

a rotating disc bracket;

a fixing bracket fixedly connected with the rotating disc bracket;

a wireless power supply device, and a framing and shaping mechanism rotatably connected with the rotating disc bracket, wherein the framing and shaping mechanism is configured to intercept and frame a light beam so as to obtain different lighting effects, and is driven by a first drive device for rotation at infinite angle, wherein the framing and shaping mechanism is provided with a second drive device for driving a framing and shaping piece thereon to function, wherein the wireless power supply device includes an electromagnetic field transmitting device arranged on the fixing bracket and an electromagnetic field receiving device arranged on the framing and shaping mechanism for transmitting power to the second drive device, wherein the stage lighting framing system of endless rotation further comprises a wireless signal transmission device, and a wireless signal receiving device corresponding to the wireless signal transmission device and arranged on the framing and shaping mechanism.

2. The stage lighting framing system of endless rotation with wireless power transmission and wireless communication according to claim 1, wherein the framing and shaping mechanism is provided with a motor control device which is in signal connection with the second drive device and the wireless signal receiving device, and is electrically connected with the electromagnetic field receiving device.

3. The stage lighting framing system of endless rotation with wireless power transmission and wireless communication according to claim 1, wherein the wireless signal transmission device and the wireless signal receiving device are provided with a micro controller unit (MCU).

4. The stage lighting framing system of endless rotation with wireless power transmission and wireless communication according to claim 1, wherein the electromagnetic field receiving device and the electromagnetic field transmitting device perform wireless power transmission by means of magnetic resonance or electromagnetic induction.

5. The stage lighting framing system of endless rotation with wireless power transmission and wireless communication according to claim 4, wherein the electromagnetic field transmitting device includes an electromagnetic field transmitting coil, a first mounting assembly for mounting the electromagnetic field transmitting coil, and an electromagnetic field transmission and wireless control circuit board for controlling transmission power of the electromagnetic field transmitting coil, and wherein the electromagnetic field receiving device includes an electromagnetic field receiving coil, a second mounting assembly for mounting the electromagnetic field receiving coil, and an electromagnetic field receiving and wireless control circuit board for converting an alternating current output from the electromagnetic field receiving coil into a direct current.

6. The stage lighting framing system of endless rotation with wireless power transmission and wireless communication according to claim 5, wherein the electromagnetic field transmission and wireless control circuit board includes an oscillator for converting a direct current into an alternating current, and an external current passes through the oscillator and the electromagnetic field transmitting coil in sequence after entering the electromagnetic field transmitting device, so that the electromagnetic field transmitting coil generates a strong varying magnetic field, then the electromagnetic field receiving coil generates an alternating current by electromagnetic induction.

7. The stage lighting framing system of endless rotation with wireless power transmission and wireless communication according to claim 5, wherein the first mounting assembly is in annular shape, and the electromagnetic field transmitting coil is nested inside the first mounting assembly which is fixed on the fixing bracket;

and/or the second mounting assembly is in annular shape, and the electromagnetic field receiving coil is nested inside the second mounting assembly which is fixed on the framing and shaping mechanism.

8. The stage lighting framing system of endless rotation with wireless power transmission and wireless communication according to claim 5, wherein the wireless signal transmission device includes a wireless controller arranged on the electromagnetic field transmission and wireless control circuit board, and a transmitting antenna arranged on the electromagnetic field transmission and wireless control circuit board or on the first mounting assembly of the electromagnetic field transmitting coil; and/or wherein the wireless signal receiving device includes a wireless controller arranged on the electromagnetic field receiving and wireless control circuit board, and a receiving antenna arranged on the electromagnetic field receiving and wireless control circuit board or on the second mounting assembly of the electromagnetic field receiving coil.

9. The stage lighting framing system of endless rotation with wireless power transmission and wireless communication according to claim 8, wherein when the transmitting antenna and the receiving antenna are provided on the first mounting assembly of the electromagnetic field transmitting coil and on the second mounting assembly of the electromagnetic field receiving coil respectively, the transmitting antenna and the receiving antenna are in annular shape, the central axes thereof are coincident, and the central axes remain coincident during the rotation at infinite angle.

10. The stage lighting framing system of endless rotation with wireless power transmission and wireless communication according to claim 9, wherein the first mounting assembly is provided with a first annular extending sidewall on which the transmitting antenna is provided, the second mounting assembly is provided with a second annular extending sidewall on which the receiving antenna is provided, and the two antennas are opposingly set when the first mounting assembly and the second mounting assembly are mounted cooperatively.

11. The stage lighting framing system of endless rotation with wireless power transmission and wireless communication according to claim 7, wherein a first nested internal cavity of the first mounting assembly for mounting the electromagnetic field transmitting coil is partially overlapped with a second nested internal cavity of the second mounting assembly for mounting the electromagnetic field receiving coil, so that the electromagnetic field transmitting coil is sufficiently close to the electromagnetic field receiving coil.

12. The stage lighting framing system of endless rotation with wireless power transmission and wireless communication according to claim 11, wherein the first nested internal cavity is provided with a magnet around the electromagnetic field transmitting coil, and the second nested internal cavity is provided with a magnet around the electromagnetic field receiving coil.

13. The stage lighting framing system of endless rotation with wireless power transmission and wireless communication according to claim 1, wherein the framing and shaping mechanism includes a framing and shaping bracket rotatably connected with the rotating disc bracket, and a framing and shaping body set on the framing and shaping bracket.

14. The stage lighting framing system of endless rotation with wireless power transmission and wireless communication according to claim 1, wherein the first drive device includes a drive motor set on the fixing bracket or the rotating disc bracket, a driving wheel connected with the drive motor, and a driven wheel which is connected with the driving wheel and is provided on the framing and shaping mechanism, so that the drive motor drives the driving wheel and the driven wheel to rotate at infinite angle.

15. The stage lighting framing system of endless rotation with wireless power transmission and wireless communication according to claim 1, wherein the first drive device includes a drive motor set on the framing and shaping mechanism, a driving wheel connected with the drive motor, and a driven wheel which is connected with driving wheel and is provided on the rotating disc bracket, so that the drive motor drives the driving wheel and the driven wheel to rotate at infinite angle.

16. The stage lighting framing system of endless rotation with wireless power transmission and wireless communication according to claim 14, wherein the driving wheel and the driven wheel are 360° rotating gears.

17. The stage lighting framing system of endless rotation with wireless power transmission and wireless communication according to claim 15, wherein the driving wheel and the driven wheel are 360° rotating gears.

18. A stage lighting luminaire comprising: a light source, and a stage lighting framing system of endless rotation with wireless power transmission and wireless communication according to claim 1, which corresponds to the light source.

19. The stage lighting luminaire according to claim 18, further comprising: a control panel for controlling the light source and the stage lighting framing system of endless rotation.

* * * * *